US008714374B2

(12) United States Patent
Bauchet et al.

(10) Patent No.: US 8,714,374 B2
(45) Date of Patent: May 6, 2014

(54) CONTAINER MOUNTING SYSTEM

(75) Inventors: Eric F. Bauchet, Stevensville, MI (US); Gil A. Gaska, Saint Joseph, MI (US); Travis M. Perkins, Granger, IN (US); Michael J. Scherzer, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 661 days.

(21) Appl. No.: 12/272,972

(22) Filed: Nov. 18, 2008

(65) Prior Publication Data

US 2010/0123063 A1 May 20, 2010

(51) Int. Cl.
*A47G 29/00* (2006.01)

(52) U.S. Cl.
USPC ..... 211/85.31; 211/106

(58) Field of Classification Search
USPC ..... 248/222.52, 690, 235, 240, 241, 249, 248/250; 211/192, 59.1, 94.01, 87.01, 106, 211/106.01, 175, 193, 85.31; 16/334; 403/84, 91, 96, 166
See application file for complete search history.

(56) References Cited

U.S. PATENT DOCUMENTS

| | | | | | |
|---|---|---|---|---|---|
| 760,831 | A | * | 5/1904 | White et al. | 16/334 |
| 1,496,588 | A | * | 6/1924 | Nord | 16/334 |
| 3,098,831 | A | | 7/1963 | Carr | |
| 3,501,015 | A | | 3/1970 | Behles | |
| 3,502,294 | A | | 3/1970 | Kalbow et al. | |
| 3,656,727 | A | | 4/1972 | Greenlee | |
| 3,698,565 | A | | 10/1972 | Weber | |
| 3,724,792 | A | * | 4/1973 | Thalenfeld | 248/220.41 |
| 3,850,396 | A | | 11/1974 | Orlandi | |
| 4,047,615 | A | | 9/1977 | Browne | |
| 4,542,876 | A | * | 9/1985 | Hogg | 248/491 |
| 4,597,616 | A | | 7/1986 | Trubiano | |
| 4,653,818 | A | | 3/1987 | DeBruyn | |
| 4,687,094 | A | | 8/1987 | Allsop et al. | |
| 4,805,784 | A | * | 2/1989 | Solheim et al. | 211/94.01 |
| 4,809,941 | A | | 3/1989 | Sheridan | |
| 4,880,192 | A | * | 11/1989 | Vom Braucke et al. | 248/110 |
| 5,014,949 | A | * | 5/1991 | Niven | 248/220.41 |
| 5,039,118 | A | * | 8/1991 | Huang | 280/47.371 |
| 5,039,902 | A | | 8/1991 | Schwarz | |
| 5,118,059 | A | | 6/1992 | Mainer | |
| 5,215,200 | A | | 6/1993 | Rosenthal | |
| 5,423,436 | A | * | 6/1995 | Morrow | 211/59.1 |
| 5,547,305 | A | * | 8/1996 | Treche | 403/97 |
| 5,901,487 | A | * | 5/1999 | Thalenfeld et al. | 40/642.01 |
| 5,964,359 | A | | 10/1999 | Marino, Jr. | |
| 6,050,426 | A | * | 4/2000 | Leurdijk | 211/94.01 |
| 6,059,124 | A | * | 5/2000 | Weck et al. | 211/57.1 |
| 6,193,079 | B1 | * | 2/2001 | Wiemer | 211/59.1 |
| 6,269,571 | B1 | * | 8/2001 | Thalenfeld | 40/642.01 |
| 6,299,001 | B1 | * | 10/2001 | Frolov et al. | 211/106 |
| 6,393,877 | B1 | * | 5/2002 | Church | 70/62 |
| 6,435,105 | B1 | | 8/2002 | Mikich et al. | |
| 6,520,350 | B1 | | 2/2003 | Smith | |

(Continued)

*Primary Examiner* — Alfred J Wujciak

(57) ABSTRACT

The invention relates to a bracket for mounting a container to a slotwall. The bracket comprises a base connected with a wire frame having an upper and lower element. The lower element provides support for the bottom of the container and the upper element may act as a lateral stop for the container. According to another embodiment of the invention, the wire frame may be rotatably coupled with the base such that the orientation of the wire frame relative to a vertical axis may be selectively adjusted.

25 Claims, 6 Drawing Sheets

(56) References Cited

U.S. PATENT DOCUMENTS

| | | | | |
|---|---|---|---|---|
| 6,607,088 | B2 | 8/2003 | Cestrone | |
| 6,644,483 | B1 * | 11/2003 | Lai | 211/87.01 |
| 6,715,427 | B2 | 4/2004 | Mikich et al. | |
| D494,842 | S * | 8/2004 | Perkins et al. | D8/354 |
| 6,811,043 | B2 * | 11/2004 | Perkins et al. | 211/94.01 |
| 6,926,160 | B2 * | 8/2005 | Perkins et al. | 211/94.01 |
| 6,935,518 | B2 * | 8/2005 | Winig et al. | 211/90.02 |
| 7,055,703 | B2 * | 6/2006 | Perkins et al. | 211/94.01 |
| 7,152,535 | B2 | 12/2006 | Mikich et al. | |
| 7,228,977 | B2 * | 6/2007 | Perkins et al. | 211/94.01 |
| 7,296,695 | B2 * | 11/2007 | Perkins et al. | 211/94.01 |
| 2005/0236544 | A1 * | 10/2005 | Mancino et al. | 248/304 |
| 2005/0247653 | A1 | 11/2005 | Brooks | |

* cited by examiner

CONTAINER MOUNTING SYSTEM

BACKGROUND OF THE INVENTION

Slotwall storage systems enable the mounting of various items to a wall by using an intervening bracket that couples to or supports the item while being received within the slots in the slotwall. One of the items mounted to the wall may include a container for holding various items.

SUMMARY OF THE INVENTION

The invention relates to a bracket for mounting a container to a slotwall. The bracket is operably coupled to a wire frame having an upper element and a lower element. The lower element provides support for the bottom of the container and the upper element may act as a lateral stop for the container. A non-slip coating may be applied to one or more of the upper and lower elements.

In another embodiment, the invention relates to a bracket comprising a wire frame rotatably coupled with a base such that the orientation of the wire frame relative to a vertical axis may be selectively adjusted.

In yet another embodiment, the invention relates to a system for mounting a container to a slotwall having a plurality of slots, comprising: first and second brackets, each having a wire frame coupled to a base, and a container supported by the wire frame.

DESCRIPTION OF EMBODIMENTS OF THE INVENTION

Figure 1:
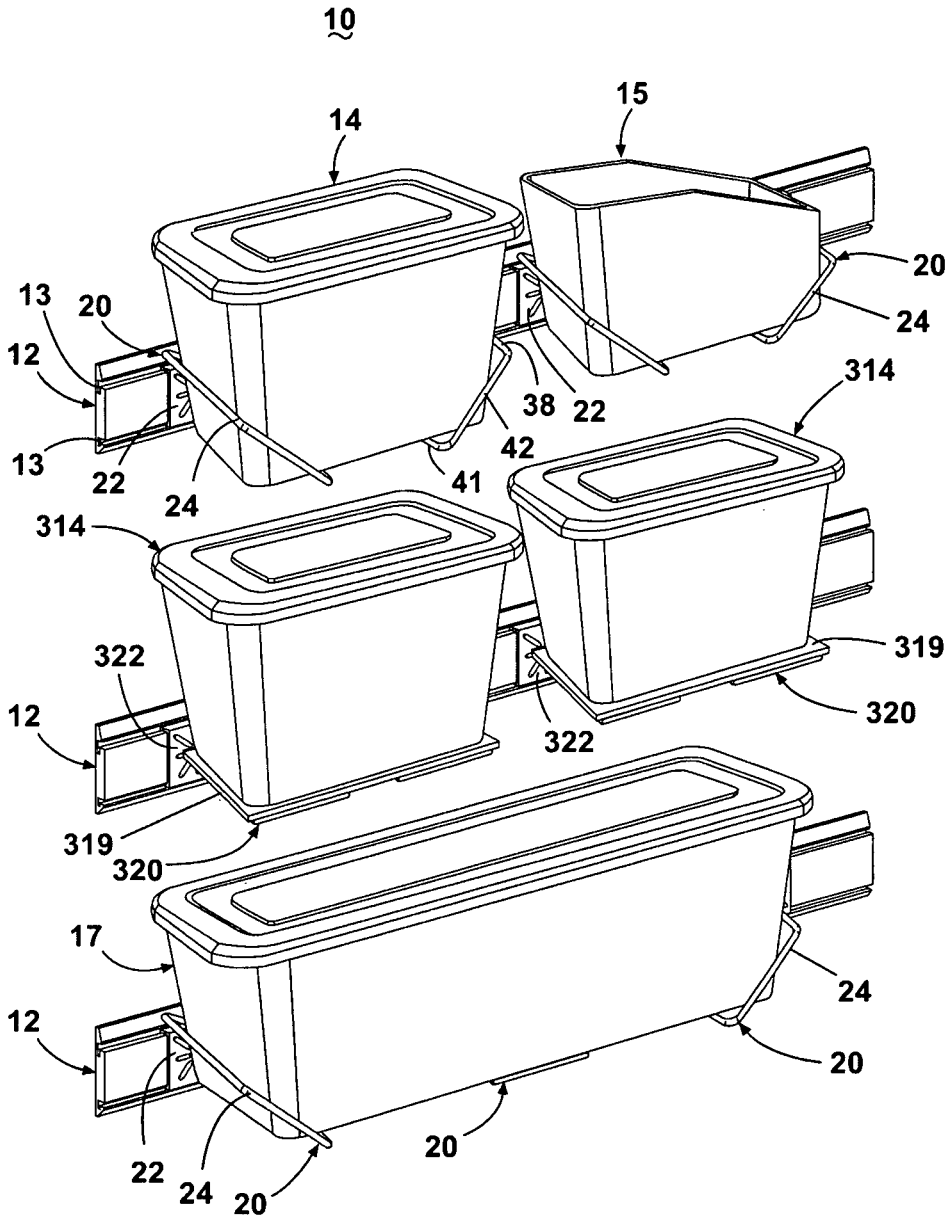
FIG. 1 is a front perspective view of a mounting system for mounting a container to a slotwall according to an embodiment of the invention.

Referring now to the figures, FIG. 1 illustrates a mounting system for mounting a container to a slotwall according to one embodiment of the invention. The mounting system 10 may be mounted to a slotwall 12, which may be of the type sold by Whirlpool Corporation under the Gladiator® trademark and disclosed in U.S. Pat. No. 6,811,043. However, the invention is not limited to any type of slotwall.

The slotwall 12 may be in the form of a track, as illustrated, or may be in the form of a panel. The slotwall 12 may be of any desired length or multiple slotwalls 12 may be combined end to end to provide a slotwall 12 of a desired length. A plurality of slotwalls 12 may be arranged on a wall to provide a mounting system 10 with multiple levels. The slotwall 12 has a plurality of slots 13. A bracket 20 may be used to mount a container 14 to the slotwall 12 using the slots 13. The bracket 20 has a base 22 and a wire frame 24 that supports a container 14.

Figure 2:
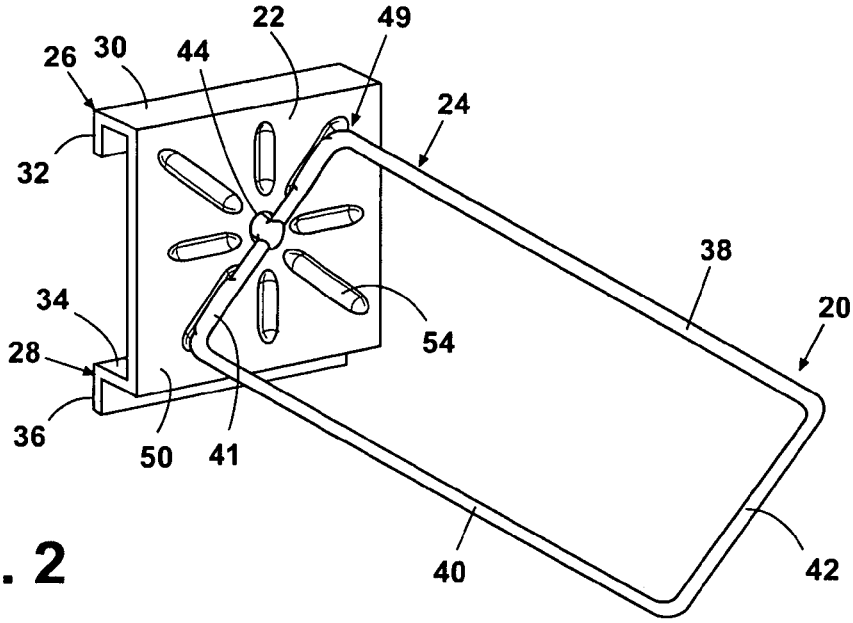
FIG. 2 is a front perspective view of a bracket with a selectively rotatable wire frame for mounting a container to a slotwall according to an embodiment of the invention.
Figure 3:
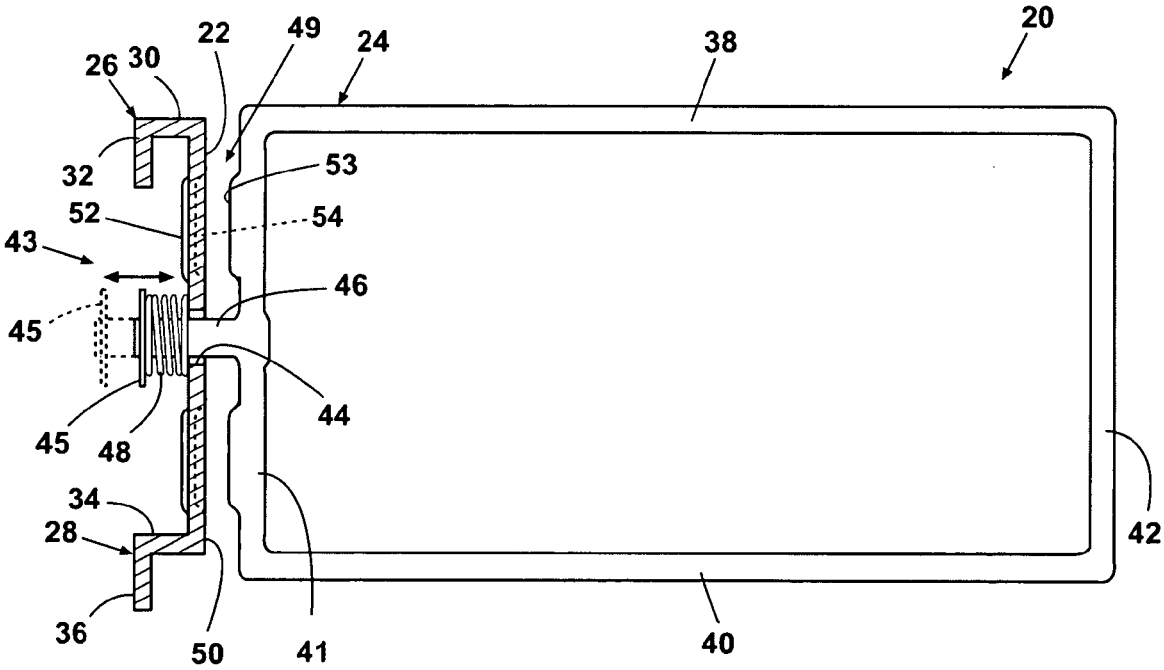
FIG. 3 is a side perspective view of the bracket of FIG. 2.

Referring now to FIGS. 2 and 3, the bracket 20 may have a first and second hook 26, 28 sized to be received in the slots 13. The first hook 26 may include a first leg 30 extending generally perpendicular to the base 22 and a second leg 32 extending from the distal end of the first leg 30 generally parallel to the base 22. The second hook 28 may include a first leg 34 extending generally perpendicular to the base 22 and a second leg 36 extending from the distal end of the first leg 34 generally parallel to the base 22 and in the same direction as second leg 32.

While the hooks 26, 28 are located on opposite edges of the base, they may be located anywhere. Also, while the hooks are illustrated to have a generally "J" shape, they may have any shape suitable for receipt within the slots 13. The hooks may also have additional components depending on the type of slotwall used and the desired features. For example, the first leg 30 may include an upwardly extending tab for limiting the lateral movement of the bracket 20 within the slotwall 12.

While the bracket 20 is illustrated for use with the slotwall 12, the hooks 26, 28 may have any size or shape suitable for use with any type of slotwall.

The wire frame 24 may have an upper element 38 and a lower element 40. The upper and lower elements 38 and 40, respectively, may be straight as illustrated, or may have other shapes and profiles. For example, upper and lower elements 38 and 40, respectively, may have a generally curved or bowed shape or an undulating profile. The upper and lower elements 38 and 40, respectively, do not necessarily need to be the same length or shape or have the same profile. While the wire frame 24 may be generally rectangular in shape, as illustrated, the wire frame 24 may have any other regular or irregular shape such as a generally triangular or oval shape, for example.

The wire frame 24 may further include a first end element 41 and a second end element 42. The second end element 42 may extend fully between the upper and lower elements 38 and 40, respectively, as illustrated, or extend only partially from one or both of the upper and lower elements 38 and 40. The end element 42 may be an extension of the wire frame 24, as illustrated, or be an additional element such as a boss, for example.

The wire frame 24 may be made from any suitable material including metal, wood or plastic, for example. Additionally, the wire frame 24 may be made from more than one material. Some or all of the parts of the wire frame 24 may also be coated with one or more materials to provide additional features such as mechanical and weather resistance, ease of use and safety features. For example, the wire frame 24 may be coated with a non-slip coating, such as polyvinyl chloride (PVC), to limit incidental slipping or sliding of an item placed on the wire frame 24.

A rotatable coupling 43 mounts the wire frame 24 to the base 22 and provides for their relative rotation. The rotatable coupling 43 comprises an arm 46 extending from the first end element 41 of the wire frame 24, through an opening 44 in the base 22, and terminating in a retainer 45. A coil spring 48 wound around the arm 46 abuts a rear face 52 of the base 22 and the retainer 45 to bias the wire frame 24 against a front face 50 of the base 22.

A rotational lock 49 is provided for fixing the rotational position of the wire frame 24 relative to the base 22. The rotational lock 49 comprises a plurality of cooperating projections 53 and locking elements in the form of recesses 54, with the projections shown extending from the first end element 41 and the recesses 54 formed in the base 22. The projections 53 may be received within the recesses 54 to fix the rotational position of the wire frame 24 at the corresponding rotational position. While illustrated as recesses, the locking elements 54 may be apertures, indentations or grooves, or pairs of raised elements in the front face 50 of the base 22. The locking elements 54 may be of any suitable size, shape and number. For example, the locking elements 54 may be generally rectangular shaped grooves, as illustrated in FIG. 2. Another example of suitable locking elements 54, would be a plurality of raised notches radially spaced around the opening 44.

To selectively rotate the wire frame 24 to a desired rotational position, the user first withdraws the projections 53 from the locking elements 54 by pulling on the wire frame 24 in a direction away from the base 22. This motion compresses the coil spring 48. The wire frame 24 may then be rotated to a desired rotational position. To secure the wire frame at the desired rotational position, the user releases the wire frame 24. The force of the coil spring 48 will draw the wire frame 24 toward the base 22 and the projections 53 will be retained within the locking elements 54. The rotational lock 49 maintains the wire frame 24 at the rotational position selected by the user.

While the rotational lock 49 is illustrated having a select number of positions for fixing the rotational position of the wire frame 24 relative to the base 22, the rotational lock 49 may be provided with any desired number of locking elements 54. The available rotational positions for fixing the wire frame 24 relative to the base 22 is dependent on the number and spacing of the locking elements 54. The rotational lock 49 may be provided with any suitable number of locking elements with any suitable spacing to provide a desired number of rotational positions.

Referring again to FIG. 1, two or more brackets 20 may be used to mount a container 14 to the slotwall 12. The lower element 40 of the wire frame 24 supports the bottom of the container 14 while the upper element 38 prevents the lateral movement of the container 14. The end element 42 prevents the sliding withdrawal of the container 14 from the bracket 20. The end element 42 may also be provided at an angle to prevent a container from tipping forward. The end element 42 may be provided at an angle by having the upper element 38 be shorter than the lower element 40.

The brackets 20 may be selectively spaced along the slotwall 12 to accommodate containers of different lengths. To accommodate containers of different heights, the wire frame 24 may be selectively rotated about a vertical axis relative to the base 22.

The user may independently adjust the angle of the wire frame 24 of each of the brackets 20 in the slotwall 12 to accommodate containers that have side walls of equal height or containers with side walls of unequal height. As illustrated in FIG. 1, the container 14 has two side walls of equal height. The container 14 is mounted to the slotwall 12 by two brackets 20 with the wire frame 24 of each of the brackets 20 oriented at the same angle relative to the vertical axis. The angle of the wire frame 24 determines the point at which the upper element 38 engages a side wall of the container 14. As the angle of rotation of the upper element 38 relative to the vertical axis increases, the point at which the upper element 38 engages the side wall of the container moves closer to the bottom of the container 14.

The angle of the wire frame 24 relative to the vertical axis also determines the lateral spacing between the upper elements 38 of the two brackets 20 used for mounting the container 14. The greater the degree of rotation about the vertical axis, the larger the spacing is between the upper elements 38 of the two brackets 20. The user may selectively adjust the angle of the wire frame 24 to prevent or limit the lateral movement of the container 14.

Figure 4:
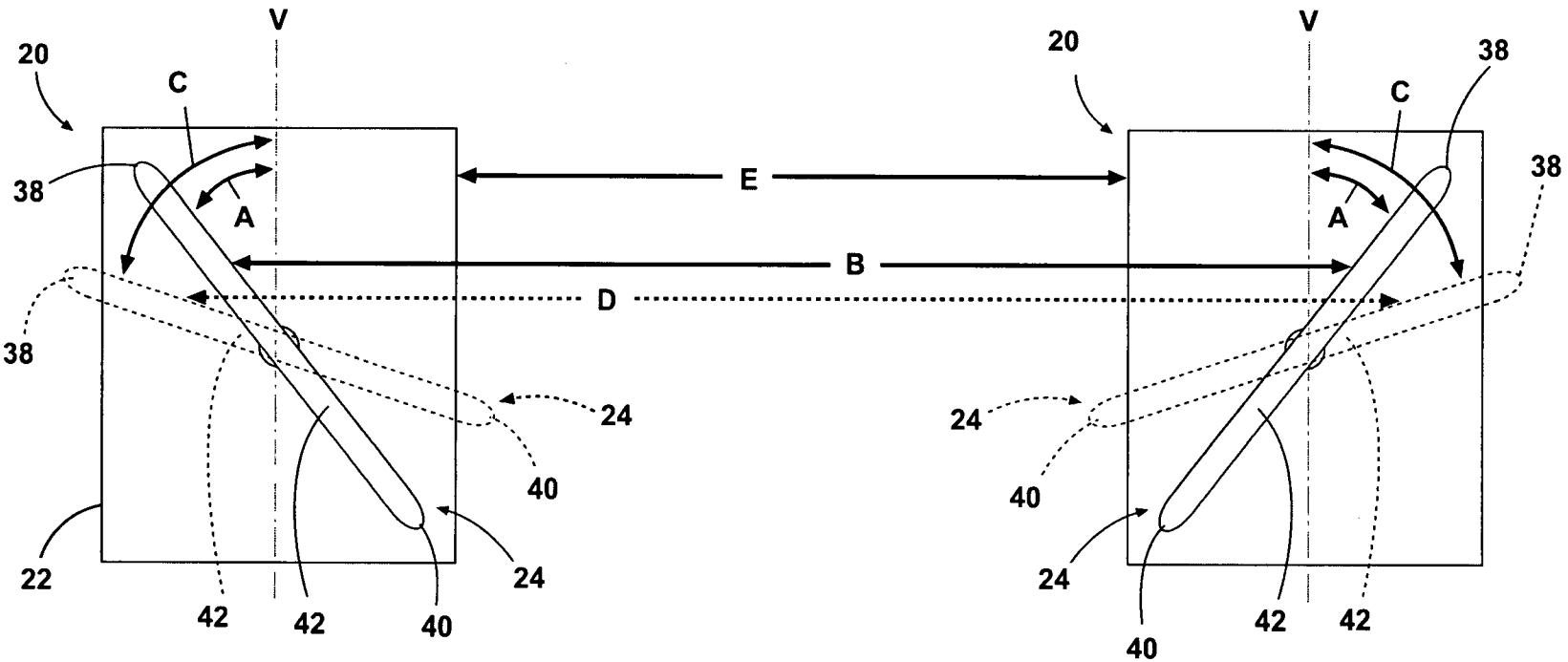
FIG. 4 is a schematic of a pair of brackets with a selectively rotatable wire frame illustrating the effect of the rotational position of the bracket on the lateral spacing between the wire frames of the pair of brackets according to an embodiment of the invention.

FIG. 4 illustrates an example of how the rotational position of the bracket 20 affects the lateral spacing between the upper elements 38 of two brackets 20. A desired rotational position of the bracket 20 may be selected by rotating the wire frame 24 about a vertical axis V relative to the base 22. When the wire frame 24 illustrated on the left is rotated counter clockwise relative to the vertical axis V by a first angle A and the wire frame 24 illustrated on the right is rotated clockwise relative to the vertical axis V by a first angle A, the lateral spacing between the upper elements 38 of the two brackets 20 has a length B. Each of the wire frames 24 may be rotated relative to the vertical axis V by a second angle C larger than the first angle A to provide a lateral spacing between the upper elements 38 with a length D, larger than the first length B.

Rotation of the bracket 20 also affects the lateral spacing between the lower elements 40. As each of the brackets 20 is rotated from the first angle A to the second angle C, the lateral spacing between the lower elements 40 of the two brackets 20 decreases.

For a given spacing E selected by the user between the brackets 20 illustrated in FIG. 4, the user may also selectively rotate the bracket 20 to affect the lateral spacing between the upper elements 38 to limit the lateral movement of a container mounted on the brackets 20. Rotation of the brackets 20 by the first angle A from the vertical axis V provides more limitation to the lateral movement of a container of a given length than rotation of the brackets 20 to the second angle C.

As illustrated in FIG. 4, the angle of rotation of the wire frame 24 also affects the vertical position of the upper element 38. As the wire frame 24 is rotated relative to the vertical axis V from the first angle A to the second angle C, the vertical position of the upper element 38 decreases. The user may mount containers of a variety of lengths and heights to the slotwall 12 by selectively adjusting the vertical position of the upper element 38 and the spacing of the brackets 20 along the slotwall 12.

Referring again to FIG. 1, a container 15 illustrates the use of the brackets 20 to mount a container with unequal wall heights. The container 15 has a first side wall with a first height and a second side wall with a second height smaller than the first height. The container 15 is mounted to the slotwall 12 in a manner similar to the container 14, except that the wire frame 24 of the two brackets 20 used to mount container 15 will each be oriented at a different angle relative to the vertical axis.

As illustrated by a container 17 mounted to the bottom row of the mounting system 10 in FIG. 1, more than two brackets 20 may be used to mount a container. The container 17 is mounted to the slotwall 12 by two end brackets 20. The brackets 20 located at each end of the container 17 are selectively rotated relative to a vertical axis such that the lower element 40 of each of the brackets 20 provides support for the bottom of the container 17 and the upper element 38 of each of the brackets 20 acts as a lateral stop. A third bracket 20 may be selectively positioned along the slotwall 12 between the two end brackets 20 to provide additional support to the bottom of the container 17. The middle support bracket 20 may be selectively rotated such that the upper element 38 and the lower element 40 are substantially parallel along a horizontal axis. More than one bracket 20 may be disposed between the two end brackets to provide additional support to long or heavy items that may be mounted to the slotwall 12.

While the bracket 20 has been illustrated with a rotatable coupling 43, it is within the scope of the invention for the wire frame 24 to be non-rotatably coupled with the base 22. The wire frame 24 may be coupled with the base 22 such that the wire frame is oriented at a pre-determined angle relative to the vertical axis. The wire frame 24 may also be provided at a fixed position wherein the upper and lower elements 38, 40 are substantially parallel along a horizontal axis.

Figure 5:
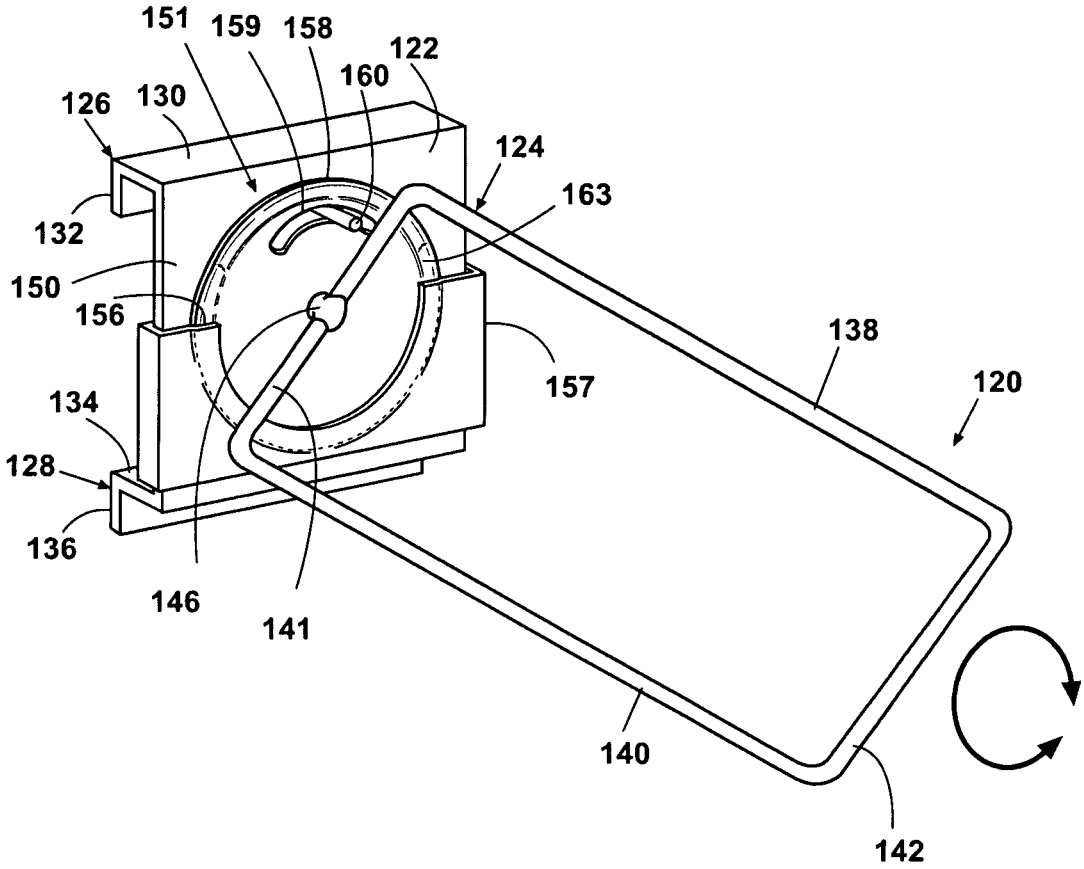
FIG. 5 is a front perspective view of a bracket with a selectively rotatable wire frame for mounting a container to a slotwall according to another embodiment of the invention.

FIG. 5 illustrates a second embodiment of the invention comprising a bracket 120, which is similar to the first bracket, except for the manner in which the wire frame is coupled to the base. Therefore, elements in the bracket 120 similar to those of bracket 20 will be numbered with the prefix 100. The bracket 120 has a base 122 and a wire frame 124 for supporting a container.

The bracket 120 may have a first and second hook 126, 128 sized to be received in the slots 13 of the slotwall 12. The first and second hooks 126, 128 may have a generally "J" shape as illustrated, or any other shape suitable for receipt within a slot of any type of slotwall.

The wire frame 124 may have an upper element 138 and a lower element 140. The upper and lower elements 138 and 140, respectively, may be straight as illustrated or may have other shapes and profiles, such as a generally curved or bowed shape or an undulating profile. The upper and lower elements 138 and 140, respectively, do not necessarily need to be the same shape or have the same profile. While the wire frame 124 may be generally rectangular in shape, as illustrated, the wire frame 124 may have any other regular or irregular shape such as a generally triangular or oval shape, for example.

The wire frame 124 may further include a first end element 141 and a second end element 142. The second end element 142 may extend fully between the upper and lower elements 138 and 140, respectively, as illustrated, or extend only partially from one or both of the upper and lower elements 138 and 140. The end element 142 may be an extension of the wire frame 124, as illustrated, or be an additional element such as a boss, for example.

A rotatable coupling 151 mounts the wire frame 124 to the base 122 and provides for their relative rotation. The rotatable coupling 151 comprises an arm 146 extending from the first end element 141 of the wire frame 124 to a plate 158. The plate 158 is rotatably received within a raised channel 156 on a front face 150 of the base 122. The plate 158 may have a slot 159 for receiving a projection 160 extending from the front face 150 of the base 122 through the slot 159.

The channel 156 may be part of a sleeve 157 that is attached to the bracket 120 or it may be integrally formed in the front face 150 of the base 122. For example, if the base 122 is made from metal, the channel 156 may be stamped into the base 122.

A user may selectively rotate the wire frame 124 to a desired rotational by grasping the wire frame 124 and rotating the wire frame 124 to the desired position. The rotation of the wire frame 124 results in the corresponding rotation of the plate 158 within the channel 156. The plate 158 may be fixed at a desired position by the frictional resistance between a rib 163 located on the plate 158 and the channel 156. Alternatively, the plate 158 may be provided with grooves or teeth that mate with one or more projections on the channel 156 to fix the plate 158 at a desired position. The projection 160 may engage the plate 158 through the slot 159 to limit the rotation of the plate 158.

Two or more brackets 120 may be used to mount a container to the slotwall 12 in the same manner that the bracket 20 may be used to mount a container to the slotwall 12 as illustrated in FIG. 1. The wire frame 124 of the bracket 120 may be rotated to a desired rotational position to mount a container to a slotwall in the same way that the wire frame 24 of the brackets 20 may be rotated to a desired rotational position to mount a container to the slotwall 12.

Figure 6A:
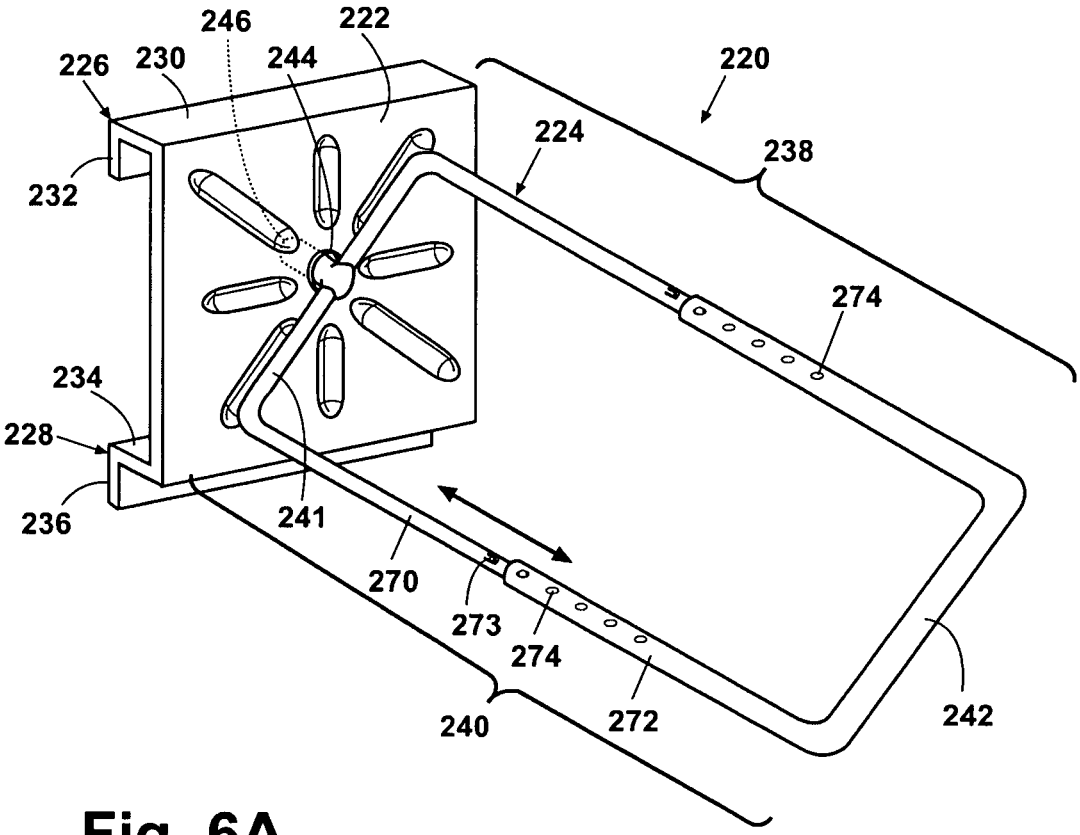
FIGS. 6A and 6B are a front perspective view of a bracket with an adjustable length wire frame according to another embodiment of the invention.

FIG. 6A illustrates a third embodiment of a bracket 220 according to the invention, which provides for adjusting the length of a wire frame 224 rotatably coupled with the bracket 220. The bracket 220 is similar to the first bracket, except for the wire frame 224 has first and second telescoping elements for adjusting the length of the wire frame 224. Therefore, elements in the bracket 220 similar to those of bracket 20 will be numbered with the prefix 200. While the adjustable length wire frame 224 is illustrated with the bracket of the first embodiment, it may be used with the bracket of any of the embodiments.

The wire frame 224 may have a generally U-shaped first telescoping element 270 connected with a generally U-shaped second telescoping element 272. The arms of each generally U-shaped first and second telescoping elements 270 and 272 extend generally perpendicular to a base 222 of the bracket 220. A part of the first generally U-shaped telescoping element 270 may form a first end element 241 and a part of the second generally U-shaped telescoping element 272 may form a second end element 242. The arms of the generally U-shaped first and second telescoping elements 270 and 272 connect to form an upper element 238 and a lower element 240 of the wire frame 224. As illustrated in FIG. 6A, the distal end of each arm of the first generally U-shaped telescoping element 270 may have a spring mounted detent 273 for selective engagement with a plurality of apertures 274 longitudinally spaced along each arm of the second generally U-shaped telescoping element 272. When the spring mounted detents are compressed, the arms of the first generally U-shaped telescoping element 270 may slide longitudinally within the arms of the second generally U-shaped telescoping element 272. The spring mounted detents decompress when they encounter an aperture 274. In this way, the spring mounted detents releasably lock the first generally U-shaped section 270 with the second generally U-shaped telescoping element 272.

Figure 6B:
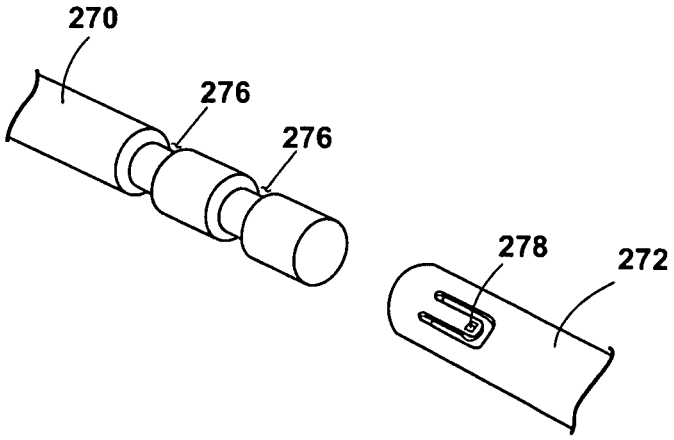

FIG. 6B illustrates another example of a locking mechanism for selectively adjusting the length of the wire frame 224. The arms of the first generally U-shaped telescoping element 270 may have longitudinally spaced notches 276 that releasably engage a spring-mounted detent 278 located within the interior space of the arms of the second generally U-shaped telescoping element 272. The notches 276 may extend partially or fully around the circumference of the first generally U-shaped telescoping element 270 and may be in the form of grooves, indentations or apertures.

While the first generally U-shaped telescoping element 270 has been described as being telescopically received within the second generally U-shaped telescoping element 272, it is within the scope of the invention for the second generally U-shaped telescoping element 272 to be telescopically received within the first generally U-shaped telescoping element 270.

Figure 7A:
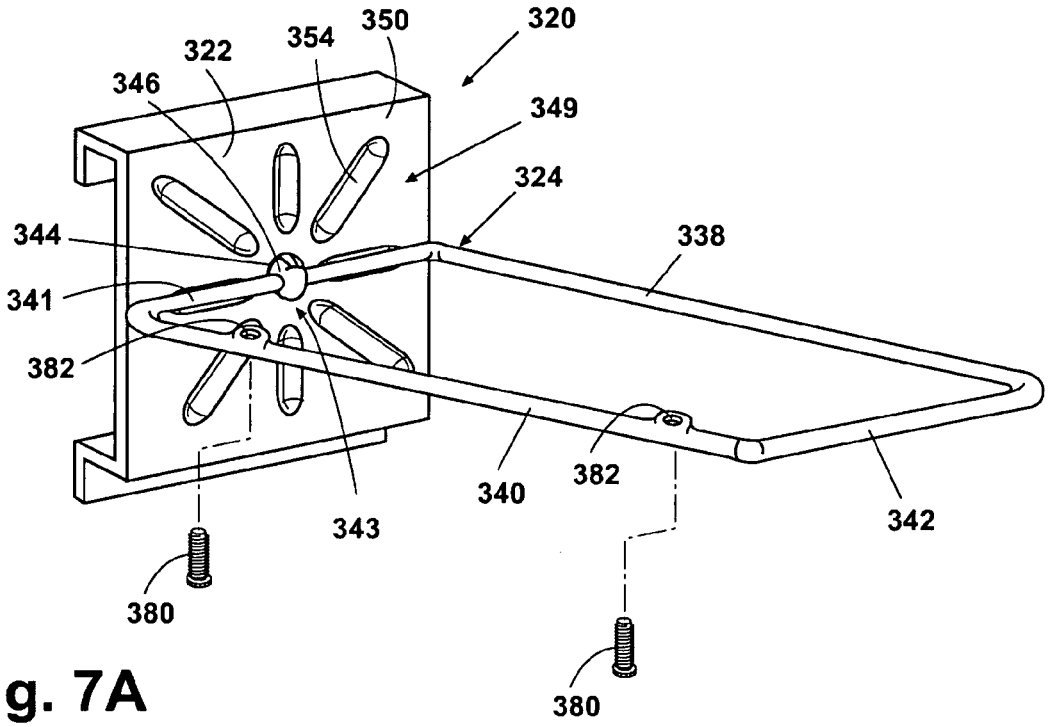
FIG. 7A is a front perspective view of a bracket with one or more couplings for securing an item to the wire frame according to an embodiment of the invention.
Figure 7B:
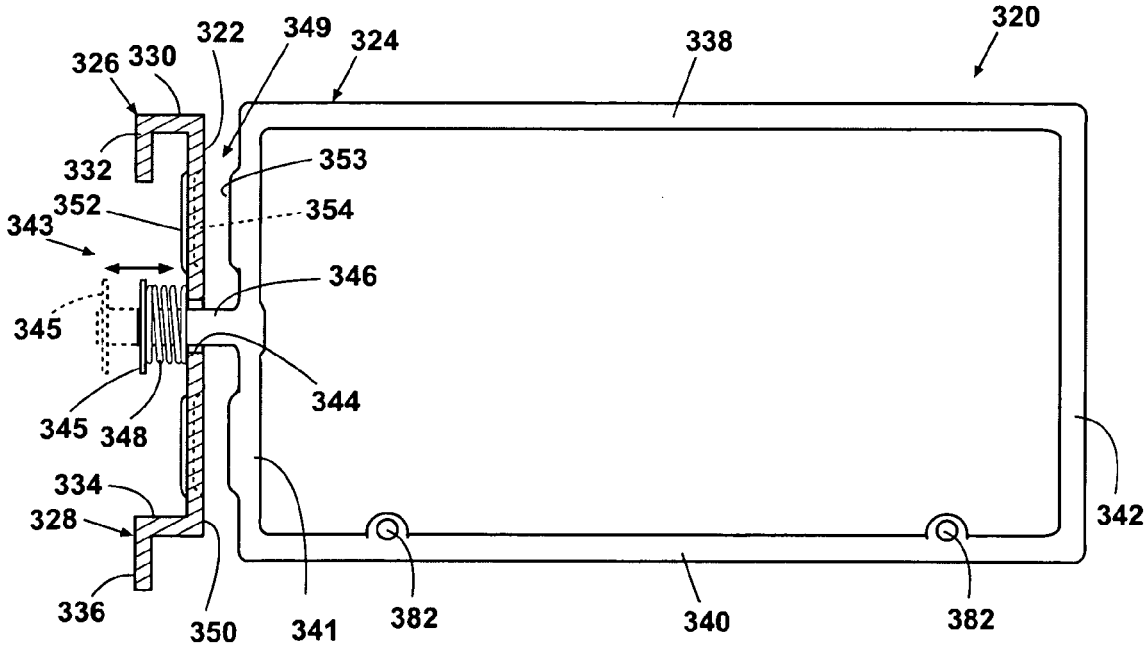
FIG. 7B is a side view of the bracket of FIG. 7A.

Referring now to FIGS. 7A and 7B, a bracket 320 is illustrated according to a fourth embodiment of the invention. The bracket 320 is similar to the first bracket, except for the shape of the wire frame. Therefore, elements in the bracket 320 similar to those of bracket 20 will be numbered with the prefix 300. The bracket 320 has a base 322 and a wire frame 324 for supporting a container or other item. While the wire frame 324 is illustrated with the bracket of the first embodiment, it may be used with a bracket of any of the embodiments.

The wire frame 324 may have an upper element 338, a lower element 340 and first and second end elements 341 and 342. The wire frame 324 may also have one or more couplings 380 for securing an item to the wire frame 324. The couplings 380 may be in the form of screws that extend through a set of apertures 382 and are threadably received by the item that is being secured to the wire frame 324. One or more apertures 382 may be located on one or more components of the wire frame 324, including the upper element 338, the lower element 340 and the first and second end elements 341, 342. The couplings 380 do not have to be screws as illustrated, but may be any type of mechanical coupling device such as a hook or a clamp, for example.

A rotatable coupling 343 mounts the wire frame 324 to the base 322 and provides for their relative rotation. The rotatable coupling 343 is similar to the rotatable coupling 43 illustrated in FIGS. 2 and 3 and is operable in the same manner. As illustrated in FIGS. 7A and 7 B, the rotatable coupling 343 comprises an arm 346 extending from the first end element 341 of the wire frame 324, through an opening 344 in the base 322, and terminating in a retainer 345. A coil spring 348 wound around the arm 346 abuts a rear face 352 of the base 322 and the retainer 349 to bias the wire frame 324 against a front face 350 of the base 322.

The bracket 320 has a rotational lock 349 for fixing the rotational position of the wire frame 324 relative the base 322. The rotational lock 349 comprises a plurality of cooperating projections 353 and locking elements in the form of recesses 354, with the projections shown extending from a first end element 341 of the wire frame 324 and the recesses 354 formed in the base 322. The rotational lock 349 is similar to the rotational lock 49 illustrated in FIGS. 2 and 3 and is operable in the same way.

While the rotatable coupling 343 and rotational lock 349 are illustrated according to one embodiment, the rotatable coupling and rotational lock is not limited to any one embodiment. The wire frame 324 may be rotatably coupled to the base 322 according to any of the embodiments.

The couplings 380 may be used to secure an item, such as a shelf, to the wire frame 324. As illustrated by the containers 314 in the middle row of the mounting system 10 in FIG. 1, two brackets 320 may be selectively spaced apart longitudinally along the slotwall 12 to accommodate a shelf 319.

To accommodate a horizontal shelf 319, the wire frame 324 of each bracket may be rotated such that the upper element 338 and the lower element 340 are substantially parallel along a horizontal axis. The wire frame 324 of each bracket 320 may be selectively rotated to the desired position in the same way that the wire frame 24 may be rotated. The user firsts withdraws the projections 353 from the locking elements 354 by pulling on the wire frame 324 and compressing the coils spring 348. The wire frame 324 may then be rotated to a desired position and fixed into position by releasing the wire frame. The force of the coil spring 348 will draw the wire frame 324 toward the base 322 and the locking projections 353 will be retained within the locking elements 354. While the couplings 380 are illustrated securing an item to the wire frame 324 along a horizontal axis, the couplings 380 may be used to secure an item to the wire frame 324 at any rotational position.

The shelf 319 may be secured to the wire frame 324 by the couplings 380, as illustrated in FIG. 7, or any other suitable mechanical connector or fastener such as hooks or clamps. Items, such as a container 314, may then be placed on the shelf 319. Alternatively, the container 314 may be secured directly to the wire frame 324 by the couplings 380.

While the invention has been described in connection with certain specific embodiments thereof, it may be understood that this is by way of illustration and not of limitation and the scope of the appended claims should be construed as broadly as the prior art will permit.

What is claimed is:

1. A bracket for mounting a container to a slotwall having a plurality of spaced slots, comprising:

a base;

at least one connector extending from the base and receivable within a slot to secure the base to the slotwall; and a container support rotatably mounted to the base and comprising a planar wire frame extending from the base and having spaced upper and lower wire elements;

wherein the wire frame may be rotated relative to the base without removal of the wire frame from the base about a rotational axis to vary a lateral spacing of the upper and lower wire elements relative to a vertical axis passing through the rotational axis to accommodate different size containers whereby the lower wire element may support a bottom of a container and the upper wire element may function as a lateral stop for a container supported by the lower wire element.

2. The bracket of claim 1 further comprising a rotatable coupling connecting the wire frame to the base whereby the wire frame may be rotated about the rotational axis to vary the lateral spacing between the vertical axis and the upper and lower wire elements.

3. The bracket of claim 1 wherein at least one of the upper wire element and lower wire element is straight.

4. The bracket of claim 3 wherein the wire frame is rectangular.

5. The bracket of claim 1 further comprising a second stop limiting a sliding withdrawal of a container supported on the wire frame.

6. The bracket of claim 5 wherein the wire frame further comprises an end wire element extending between the upper wire element and the lower wire element to form the stop.

7. The bracket of claim 1 wherein the at least one connector comprises a hook sized to be received within the slot.

8. The bracket of claim 1 wherein a length of the upper and lower wire elements is adjustable.

9. The bracket of claim 8 wherein the wire frame comprises first and second telescoping elements, which may be moved relative to each other to adjust a length of the wire frame.

10. The bracket of claim 9 wherein the wire frame further comprises at least one detent for fixing a relative position of the first and second telescoping elements.

11. The bracket of claim 1 wherein at least one of the upper wire element and lower wire element further comprises one or more couplings for securing one or more items to the wire frame.

12. A bracket for mounting a container to a slotwall having a plurality of spaced slots, comprising:

a base;

at least one connector extending from the base and receivable within a slot to secure the base to the slotwall; and a container support comprising a planar wire frame extending from the base and having spaced upper and lower wire elements, with at least one of the upper and lower wire elements having a no-slip coating;

wherein the wire frame may be rotated relative to the base without removal of the wire frame from the base about a rotational axis to vary a lateral spacing of the upper and lower wire elements relative to a vertical axis passing through the rotational axis to accommodate different size containers whereby the lower wire element may support a bottom of a container and the upper wire element may function as a lateral stop for a container supported by the lower wire element.

13. The bracket of claim 12 wherein both the upper and lower wire elements have a no-slip coating.

14. The bracket of claim 12 further comprising a rotatable coupling connecting the wire frame to the base whereby the wire frame may be rotated to vary a position of the wire frame relative to the base.

15. The bracket of claim 12 wherein the wire frame is rectangular.

16. The bracket of claim 12 further comprising a second stop limiting a sliding withdrawal of a container supported on the wire frame.

17. The bracket of claim 12 wherein the at least one connector comprises a hook sized to be received within the slot.

18. The bracket of claim 12 wherein the wire frame comprises first and second telescoping elements, which may be moved relative to each other to adjust a length of the wire frame.

19. The bracket of claim 18 wherein the wire frame further comprises at least one detent for fixing a relative position of the first and second telescoping elements.

20. The bracket of claim 12 wherein the wire frame further comprises one or more couplings for securing one or more items to the wire frame.

21. A mounting system for mounting a container to a slotwall having a plurality of spaced slots, comprising:

at least a first and second bracket, with each bracket comprising:

a base;

at least one connector extending from the base and receivable within a slot to secure the base to the slotwall; and a container support rotatably mounted to the base and comprising a planar wire frame with upper and lower wire elements oriented at an angle relative to a vertical axis such that the upper and lower wire elements are laterally spaced relative to the vertical axis;

wherein the wire frame may be rotated relative to the base without removal of the wire frame from the base about a rotational axis to vary a lateral spacing of the upper and lower wire elements relative to the vertical axis, the vertical axis passing through the rotational axis, to accommodate different size containers whereby the lower wire element may support a bottom of a container and the upper wire element may function as a lateral stop for a container supported by the lower wire element;

wherein the at least first and second brackets may be mounted to the slotwall in spaced relationship.

22. The mounting system of claim 21 further comprising a rotatable coupling connecting the wire frame to the base whereby the wire frame may be rotated to vary a position of the wire frame relative to the base.

23. The mounting system of claim 21 wherein the first and second brackets are at different rotational orientations.

24. The mounting system of claim 21 further comprising a third bracket spaced from the first and second brackets.

25. The mounting system of claim 21 wherein at least one of the upper and lower wire elements have a no-slip coating.

* * * * *